US006598842B1

(12) United States Patent
Yeh

(10) Patent No.: US 6,598,842 B1
(45) Date of Patent: Jul. 29, 2003

(54) WINDMILL IN COMBINATION WITH A TORCH SUPPORT

(76) Inventor: Jui-Ju Yeh, 14th Fl., No. 223, Sec. 5, Nanking E. Rd., Taipei (TW)

( * ) Notice: Subject to any disclaimer, the term of this patent is extended or adjusted under 35 U.S.C. 154(b) by 0 days.

(21) Appl. No.: 10/153,962

(22) Filed: May 22, 2002

(51) Int. Cl.[7] ..... E04G 5/06

(52) U.S. Cl. ..... 248/231.71; 248/159; 248/310; 416/5; 431/343; 446/217; 362/414

(58) Field of Search ..... 416/5; 431/343, 431/320, 345; D26/8, 10; 446/217, 218; 248/231.71, 310, 159; 362/806, 810, 811, 431, 410, 414

(56) References Cited

U.S. PATENT DOCUMENTS 571,449 A * 11/1896 Laube ..... 446/217
1,433,098 A * 10/1922 Reynolds et al. ..... 446/218
1,714,808 A * 5/1929 Oliphant ..... 416/17
D86,731 S * 4/1932 Meng ..... D26/10
4,200,904 A * 4/1980 Doan ..... 362/183
5,273,402 A * 12/1993 Maury ..... 416/246
6,217,316 B1 * 4/2001 Yeh ..... 431/343
6,305,108 B1 * 10/2001 Lin ..... 40/406
D456,917 S * 5/2002 Kumar ..... D26/8

FOREIGN PATENT DOCUMENTS

DE 2913723 B1 * 3/1980 ..... F23Q/7/00
DE 10106318 A1 * 8/2001 ..... F21S/10/04

* cited by examiner

*Primary Examiner*—Korie Chan
(74) *Attorney, Agent, or Firm*—William E. Pelton, Esq.

(57) ABSTRACT

A windmill is securely mounted at a mediate portion of a torch support which is compose of a first column, a second column and an arcuate plate sandwiched between the first column and the second column so as to clamp thereon the windmill via a thread.

1 Claim, 3 Drawing Sheets

WINDMILL IN COMBINATION WITH A TORCH SUPPORT

BACKGROUND OF THE INVENTION

1. Field of the Invention

The present invention relates to a windmill in combination with a torch support, and more particularly to a torch support having a windmill mounted in a mediate portion of the support so that the torch support is able to present entertainment and ornamental effect to the environment.

2. Description of Related Art

A conventional torch support is only a column to support thereon a torch. No matter the torch is an electrical torch or a torch with flames, the column is just a column. When this kind of conventional torch support is provided on a fence or around a compound, only can the flames bring a little diversity to the environment. That is, the conventional torch support is dull and boring.

To overcome the shortcomings, the present invention tends to provide an improved torch support to mitigate and obviate the aforementioned problems.

SUMMARY OF THE INVENTION

The primary objective of the present invention is to provide an improved torch support. The torch support can not only support a torch thereon, but also have a windmill mounted at a mediate portion of the torch support such that the movement of the blades of the windmill is able to bring entertainment effect to the environment.

In order to accomplish the foregoing objective, the torch support has a first column, a second column and an arcuate plate connecting the first column to the second column. A segment of a thread extends between a bottom end of the first column and a top end of the second column and in the arcuate plate so as to function as a base for supporting and clamping thereon a windmill. When the windmill is in operation, the movement of the blades of the windmill brings a lively atmosphere to the environment.

Other objects, advantages and novel features of the invention will become more apparent from the following detailed description when taken in conjunction with the accompanying drawings.

DETAILED DESCRIPTION OF THE PREFERRED EMBODIMENT

Figure 1:
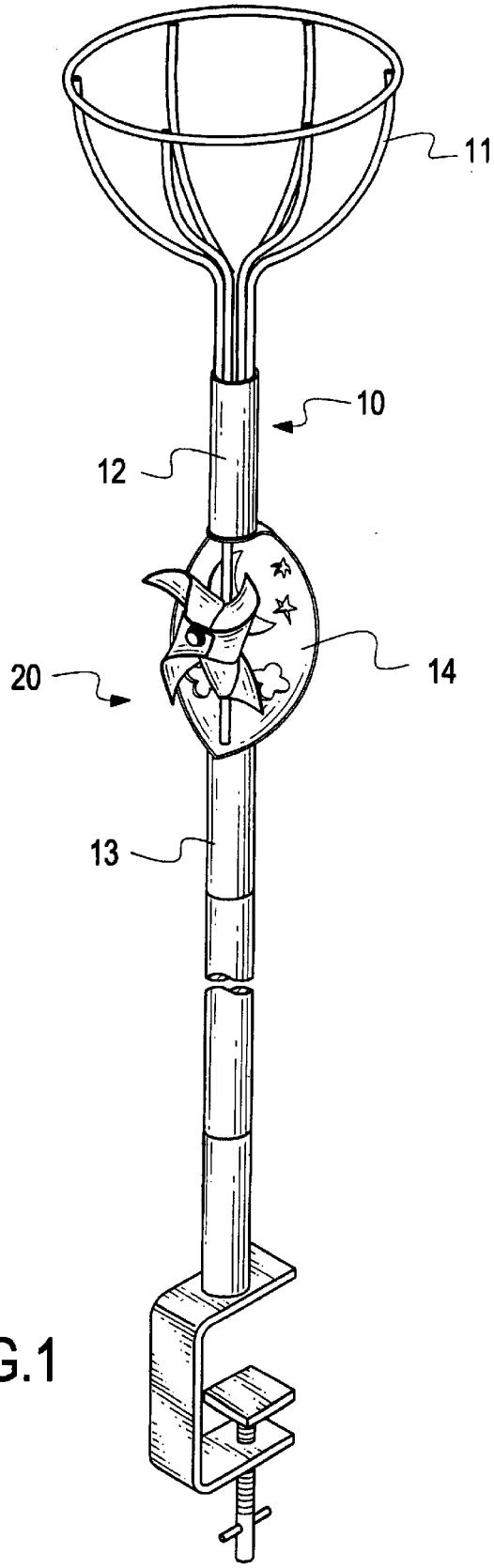
FIG. 1 is a perspective view of the torch support in combination with a windmill of the present invention.
Figure 2:
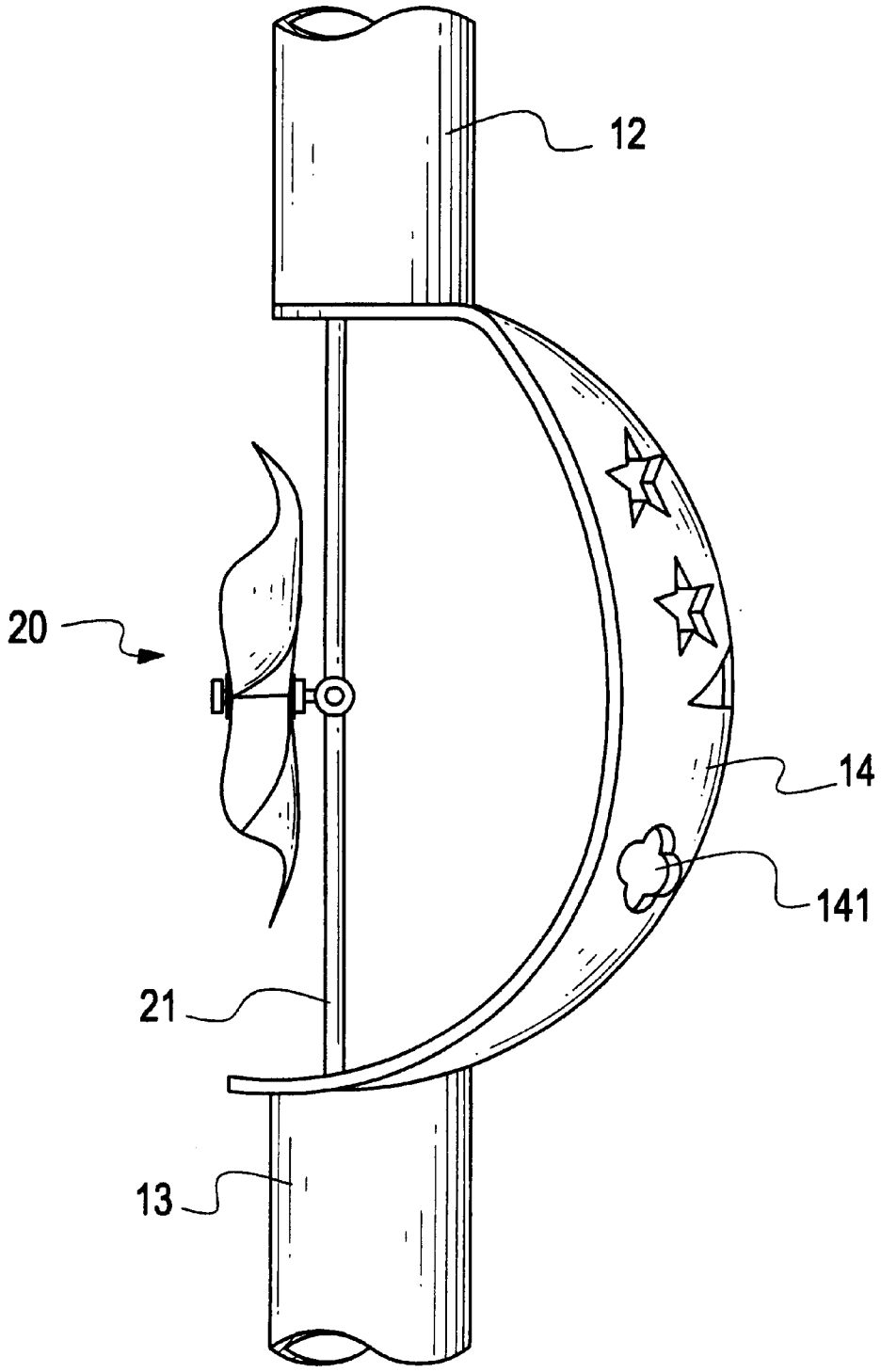
FIG. 2 is a side plan view showing the relationship between the columns of the torch support and the arcuate plate.

With reference to FIGS. 1 and 2, a torch support (10) in combination with a windmill (20) is shown. The torch support (10) includes a bowl (11) formed on top of a first column (12), a second column (13) securely connected with the first column (12) via an arcuate plate (14) sandwiched between the first and second columns (12,13).

The arcuate plate (14) is sandwiched between a bottom of the first column (12) and a top of the second column (13) and has through holes (141) of various patterns. A thread (21) extends between the bottom of the first column (12) and the top of the second column (13) and inside the arcuate plate (14) to function as a base for clamping thereon the windmill (20).

Figure 3:
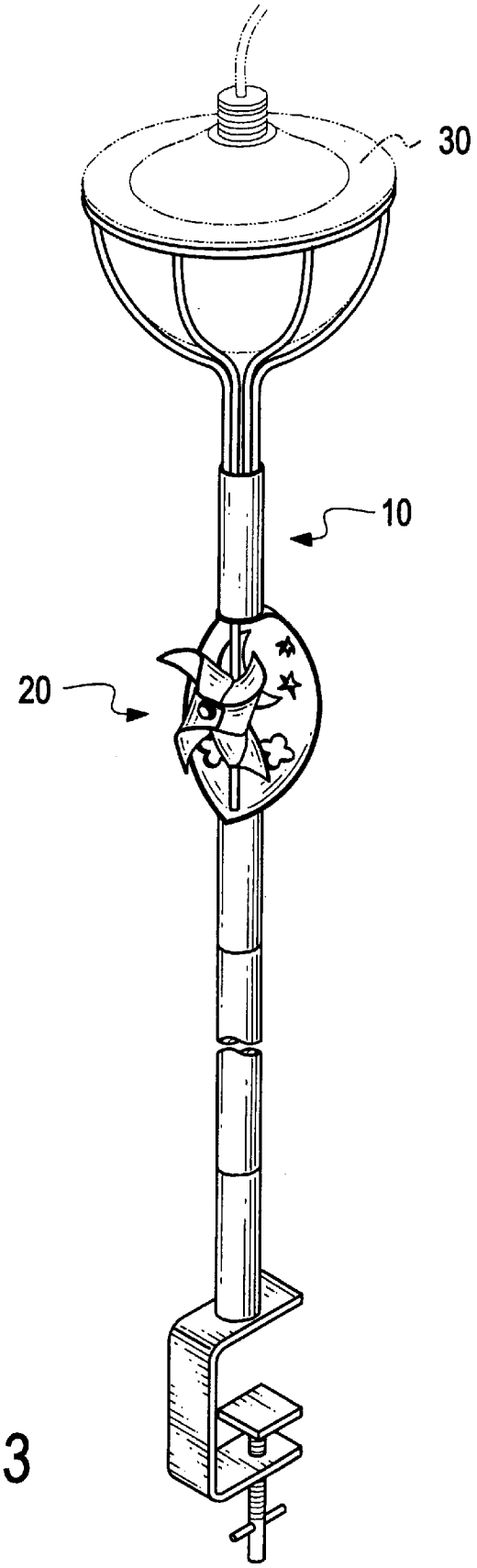
FIG. 3 is a perspective view of the present invention, wherein an oil lamp is received in the torch support.

It is seen from FIG. 3 that an oil lamp (30) (in dashed lines) is received in the bowl (11) of the torch support (10), while the windmill (20) is mounted at the joint of the first column (12) and the second column (13). With such an arrangement, the windmill (20) is able to bring additional ornamental and entertainment effect to the environment. However, it is appreciated from the foregoing description that changes of the windmill (20) to other ornamental and entertainment objects are easily accomplished. The change can be made after reading the description of the preferred embodiment of the present invention and should still fall in the claimed scope.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A torch support comprising:

a first column;

a bowl formed on top of the first column for receiving therein a torch;

a second column securely connected with the first column via an arcuate plate sandwiched between the first and second columns; wherein the arcuate plate is sandwiched between a bottom of the first column and a top of the second column and has through holes defined therethrough;

a thread extending between the bottom of the first column and the top of the second column and inside the arcuate plate to function as a base for clamping thereon a windmill.

* * * * *